US009346267B2

(12) United States Patent
Horiguchi

(10) Patent No.: US 9,346,267 B2
(45) Date of Patent: May 24, 2016

(54) LIQUID JET HEAD AND LIQUID JET APPARATUS

(71) Applicant: SII PRINTEK INC., Chiba-shi, Chiba (JP)

(72) Inventor: Satoshi Horiguchi, Chiba (JP)

(73) Assignee: SII PRINTEK INC. (JP)

( * ) Notice: Subject to any disclaimer, the term of this patent is extended or adjusted under 35 U.S.C. 154(b) by 0 days.

(21) Appl. No.: 14/509,695

(22) Filed: Oct. 8, 2014

(65) Prior Publication Data

US 2015/0109373 A1 Apr. 23, 2015

(30) Foreign Application Priority Data

Oct. 17, 2013 (JP) ..... 2013-216584

(51) Int. Cl.
*B41J 2/015* (2006.01)
*B41J 2/045* (2006.01)
*B41J 2/14* (2006.01)

(52) U.S. Cl.
CPC ..... *B41J 2/14209* (2013.01)

(58) Field of Classification Search
None
See application file for complete search history.

(56) References Cited

U.S. PATENT DOCUMENTS

2012/0212548 A1* 8/2012 Koseki ..... 347/71

FOREIGN PATENT DOCUMENTS

| | | |
|---|---|---|
| EP | 2193921 | 9/2010 |
| GB | 2511190 | 8/2014 |
| JP | 2001277503 | 10/2001 |
| JP | 2003505281 | 2/2003 |
| JP | 2012101437 | 5/2012 |

OTHER PUBLICATIONS

IPO Search Report mailed Apr. 16, 2015 issued in GB Patent Appln. No. GB1418434.5.

* cited by examiner

*Primary Examiner* — Erica Lin
(74) *Attorney, Agent, or Firm* — Adams & Wilks

(57) ABSTRACT

A liquid jet head includes a piezoeletric body substrate and an opaque substrate bonded to the piezoelectric body substrate. The piezoeletric body substrate has ejection grooves arrayed with an identical pitch P in a reference direction and non-ejection grooves arrayed alternately with the ejection grooves while shifted from the ejection grooves by a half pitch (P/2). The opaque substrate has through holes arrayed in the reference direction. The through holes include a row of through holes corresponding in number to and communicating with the respective ejection grooves, a first through hole arranged outside of one end side of the row of through holes so that it does not communicate with any of the ejection grooves, and a second through hole arranged outside of another end side of the row of through holes so that it does not communicate with any of the ejection grooves.

20 Claims, 9 Drawing Sheets

LIQUID JET HEAD AND LIQUID JET APPARATUS

BACKGROUND

1. Technical Field

The present invention relates to a liquid jet head which jets a liquid droplet onto a recording medium to perform recording thereon, and to a liquid jet apparatus.

2. Related Art

In recent years, there is used a liquid jet head which employs an ink jet method to record a character and/or a figure on a sheet of recording paper or the like by ejecting thereon an ink droplet, or to form a functional thin film on a surface of an element substrate by ejecting thereon a liquid material. In this method, liquid such as ink or the liquid material is guided from a liquid tank to a channel through a supply tube so that the liquid filling the channel is pressurized and ejected from a nozzle communicating with the channel. The liquid is ejected to record a character and/or a figure or form a functional thin film having a predetermined shape by moving a liquid jet head and/or a recording medium.

A liquid jet head of this type is described in JP 2012-101437 A. FIG. 8 is an exploded perspective view of the liquid jet head described in JP 2012-101437 A. A liquid jet head 201 includes a piezoelectric body substrate 202, a cover plate 203 bonded to a surface SF of the piezoelectric body substrate 202, and a nozzle plate 216 bonded to a front end FE of the piezoelectric body substrate 202. A dummy channel 212 and an ejection channel 211 are alternately arrayed on the surface SF of the piezoelectric body substrate 202. The cover plate 203 includes a liquid supply chamber 214 and a slit 215 which only communicates with the ejection channel 211 but does not communicate with the dummy channel 212. The nozzle plate 216 includes a nozzle 217, which communicates with the ejection channel 211 opened on the front end FE. The ejection channel 211 and the dummy channel 212 are separated by a partition 206, and a drive electrode 207 is formed on a side surface of the partition 206. The drive electrode 207 is electrically connected to an electrode terminal formed on the surface SF of the piezoelectric body substrate 202 in the vicinity of a rear end RE thereof. A flexible circuit board 204 is connected to the surface SF in the vicinity of the rear end RE so that a drive signal is supplied from outside. Liquid supplied to the liquid supply chamber 214 flows into the ejection channel 211 through the slit 215. The partition 206 is deformed when the drive signal is supplied to the drive electrode 207, thereby causing the capacity of the ejection channel 211 to change abruptly and causing the liquid droplet to be ejected from the nozzle 217.

Described in JP 2003-505281 W is a liquid jet head of a through-flow type in which liquid within a channel circulates. The through-flow type can promptly discharge air bubbles and/or a foreign matter mixed in the liquid out of the channel. As a result, maintenance can be carried out without using a cap structure or a service station, whereby the liquid is consumed less at the time of the maintenance to be able to keep down a running cost. Moreover, the wasteful consumption of a recording medium caused by defective ejection can be kept to the minimum.

FIG. 9 is an exploded perspective view of the liquid jet head described in JP 2003-505281 W. The liquid jet head includes: PZT wafers 88 and 89 formed of two piezoelectric elements stacked together to construct flow paths 90, 92, and 94; a mask plate 100 on which an opening that communicates with each of the flow paths 90 and 94 is formed but which blocks the flow path 92; an opening plate 66 on which an opening portion is formed to bring the flow path 90 in communication with the flow path 94 while striding over the flow path 92; and a nozzle plate 64 on which a nozzle 102 communicating with the opening portion on the opening plate 66 is formed. Liquid flows from the flow path 90 to the flow path 94 through the opening portion formed on the opening plate 66, as indicated by arrow 52. In other words, the liquid circulates around the flow path 92. A line electrode is provided on a side surface of each of two walls 96 and 98 facing the flow path 92 while an earth electrode is provided on a side surface of each of the walls facing the flow paths 90 and 94, so that the walls 96 and 98 are driven by these electrodes to eject small liquid droplets from the nozzle 102.

The groove width and groove interval of the ejection channel 211 and the dummy channel 212 have been getting narrower, down to 100 μm to 20 μm, in recent years. It is thus required to align the nozzle 217 on the nozzle plate 216 and the ejection channel 211 opened at the front end FE with high precision in the liquid jet head described in JP 2012-101437 A, for example. It is difficult to accurately perform the alignment especially when an opaque material such as a metal plate is used as the nozzle plate 216, because the ejection channel 211 is not visible through the nozzle plate 216 when the nozzle plate 216 is to be bonded to the front end FE. The positioning accuracy decreases when the nozzle plate 216 and the piezoelectric body substrate 202 are aligned by using the outer shape as a reference, for example. When attempting to align the nozzle 217 with the ejection channel 211 opened at the front end FE through the nozzle, one cannot distinguish whether the opening visible through the nozzle 217 is the opening of the ejection channel 211 or the opening of the dummy channel 212.

A similar problem can also occur when installing the cover plate 203 onto the ejection channel 211 formed on the surface SF of the piezoelectric body substrate 202. The cover plate 203 normally being opaque, the ejection channel 211 and the dummy channel 212 are not visible through the cover plate 203 when bonding the cover plate to the surface SF. Now, when attempting to perform the alignment with a groove seen through the slit 215, one cannot always distinguish whether the groove seen through the slit 215 is the ejection channel 211 or the dummy channel 212.

Moreover, the liquid jet head described in JP 2003-505281 W is formed of many components including the mask plate 100, the opening plate 66, and the nozzle plate 64 to circulate liquid, so that it gets extremely complex to align each plate. It is difficult to perform the alignment with high precision when one attempts to adhere these components to the PZT wafers 88 and 89 by using the outer shape as a reference.

SUMMARY OF THE INVENTION

A liquid jet head according to the present invention includes: a first piezoelectric body substrate which has n pieces (where n is an integer of 1 or larger) of ejection grooves arrayed with an identical pitch P in a reference direction on a surface and (n+1) pieces of non-ejection grooves arrayed alternately with the ejection grooves while shifted from the ejection grooves by a half pitch (P/2); and an opaque substrate which is bonded to the surface of the first piezoelectric body substrate and has (j+n+k) pieces (where each of j and k is an integer of 1 or larger) of through holes passing through the substrate in a board thickness direction and arrayed in the reference direction, where each of n pieces of the through holes communicates with each of the n pieces of the ejection grooves, and j pieces of the through holes located at one end side of a row of holes formed of the n pieces of the through holes communicating with the ejection grooves as well as k pieces of the through holes located at another end side of the row do not communicate with the ejection grooves.

Moreover, the through hole arranged in a j-th place out of the j pieces of the through holes located at the one end side of the row of holes and the through hole arranged first in the row of holes are separated by the pitch P or the half pitch (P/2), while the through hole arranged in an n-th place in the row of holes and the through hole arranged first in the k pieces of the through holes located at the other end side of the row of holes are separated by the pitch P or the half pitch (P/2).

The j pieces of the through holes located at the one end side of the row of holes and the k pieces of the through holes located at the other end side of the row are placed at a location overlapping with a range of an opening region in which the non-ejection groove is opened toward the opaque substrate, in a direction orthogonal to a reference direction K and parallel to a substrate surface of the opaque substrate.

The opaque substrate is a nozzle plate which includes n pieces of nozzles formed of the n pieces of the through holes.

There is further included a nozzle plate having n pieces of nozzles, where each of the n pieces of the nozzles communicates with the n pieces of the through holes, and the nozzle plate is bonded to a side of the opaque substrate opposite to the side bonded to the first piezoelectric body substrate.

The ejection groove and the non-ejection groove are placed on a top surface of the first piezoelectric body substrate, and the opaque substrate is a cover plate which has a liquid chamber communicating with the n pieces of the through holes and is bonded to the top surface.

The n pieces of the ejection grooves and the (n+1) pieces of the non-ejection grooves are opened on a side surface of the first piezoelectric body substrate.

There is further included a second piezoelectric body substrate which has n pieces of ejection grooves arrayed with the identical pitch P in the reference direction on the surface and (n+1) pieces of non-ejection grooves arrayed alternately with the ejection grooves while shifted from the ejection grooves by the half pitch (P/2), where the first piezoelectric body substrate and the second piezoelectric body substrate are formed into a 1 piece while arranging side surfaces of each of the piezoelectric body substrates flush with each other and arranging bottom surfaces opposite to the top surface of the substrates to face each other, and the through hole brings the ejection groove opened on the side surface of the first piezoelectric body substrate in communication with the ejection groove opened on the side surface of the second piezoelectric body substrate.

There is further included a first cover plate which has a first liquid chamber and n pieces of slits communicating with the first liquid chamber, and a second cover plate which has a second liquid chamber and n pieces of slits communicating with the second liquid chamber, where the first cover plate is bonded to a top surface of the first piezoelectric body substrate while each of the n pieces of the slits communicates with each of the n pieces of the ejection grooves, and the second cover plate is bonded to a top surface of the second piezoelectric body substrate while each of the n pieces of the slits communicates with each of the n pieces of the ejection grooves.

The n pieces of the ejection grooves and the (n+1) pieces of the non-ejection grooves are opened on the top surface of the first piezoelectric body substrate and a bottom surface of the substrate opposite to the top surface.

A liquid jet apparatus according to the present invention includes the liquid jet head, a move mechanism which moves the liquid jet head and a recording medium relatively to each other, a liquid supply tube which supplies liquid to the liquid jet head, and a liquid tank which supplies the liquid to the liquid supply tube.

The liquid jet head according to the present invention includes: the first piezoelectric body substrate which has the n pieces (where n is an integer of 1 or larger) of the ejection grooves arrayed with the identical pitch P in the reference direction on the surface and the (n+1) pieces of the non-ejection grooves arrayed alternately with the ejection grooves while shifted from the ejection grooves by the half pitch (P/2); and the opaque substrate which is bonded to the surface of the first piezoelectric body substrate and has the (j+n+k) pieces (where each of j and k is an integer of 1 or larger) of the through holes passing through the substrate in the board thickness direction and arrayed in the reference direction, where each of the n pieces of the through holes communicates with each of the n pieces of the ejection grooves, and the j pieces of the through holes located at the one end side of the row of holes formed of the n pieces of the through holes communicating with the ejection grooves as well as the k pieces of the through holes located at the other end side of the row do not communicate with the ejection grooves. As a result, the position between the n pieces of the ejection grooves on the first piezoelectric body substrate and the n pieces of the through holes on the opaque substrate can be determined from a surface state of the first piezoelectric body substrate seen through the j pieces of the through holes at the one end side and the k pieces of the through holes at the other end side, whereby the alignment of the two substrates can be greatly facilitated.

DETAILED DESCRIPTION

First Embodiment

Figure 1A:
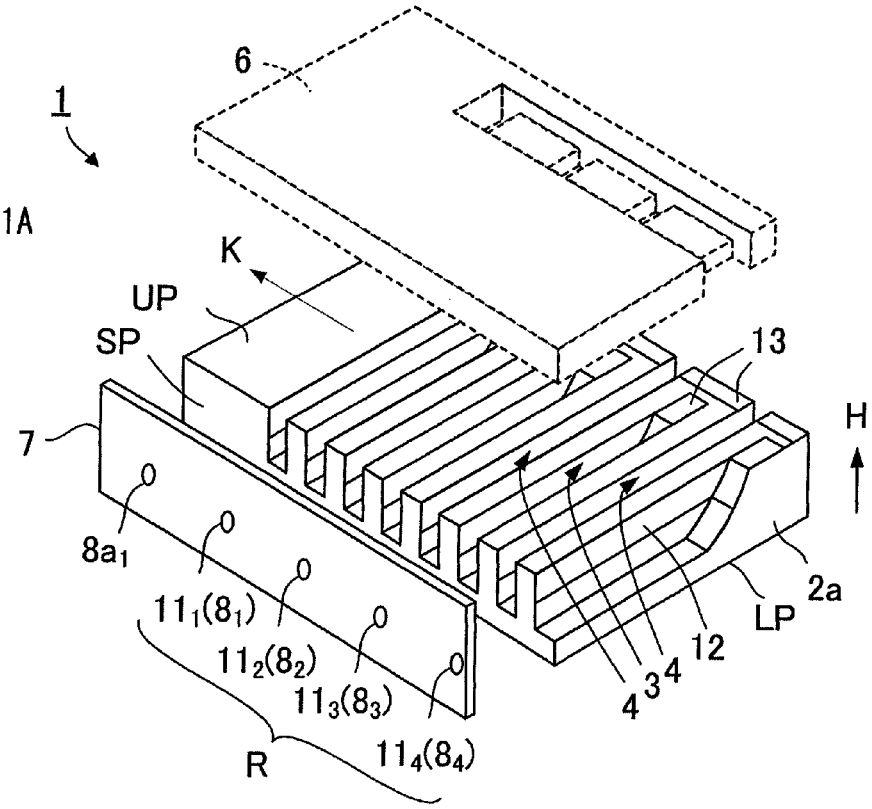
FIGS. 1A to 1D are diagrams illustrating a liquid jet head according to first embodiment of the present invention.
Figure 1B:
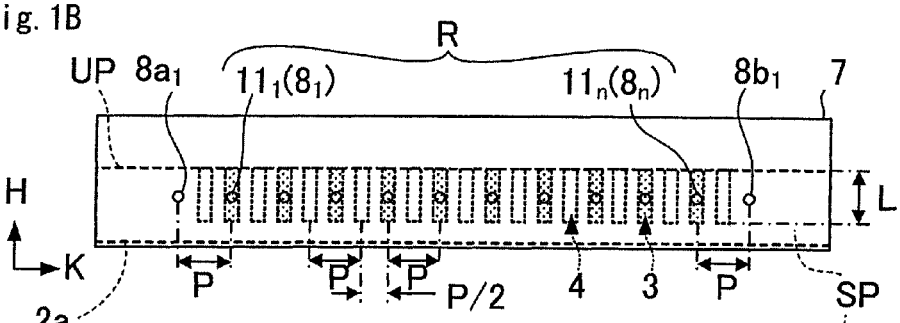
Figure 1C:
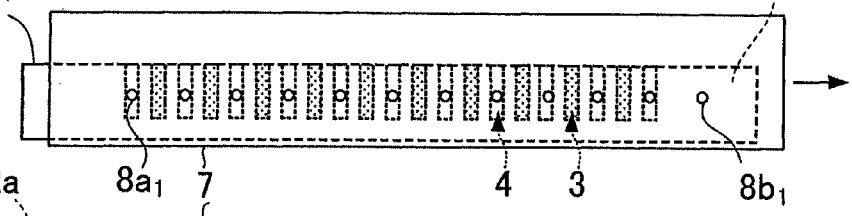
Figure 1D:
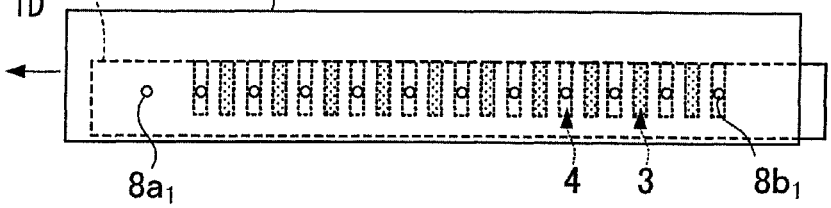

FIGS. 1A to 1D are diagrams illustrating a liquid jet head 1 according to first embodiment of the present invention. FIG. 1A is a partial exploded perspective view schematically illustrating the liquid jet head 1, while each of FIGS. 1B to 1D is a schematic front view of the liquid jet head 1 seen from a side of a nozzle plate 7. The present embodiment relates to a structure where alignment between a first piezoelectric body substrate 2*a* and the opaque nozzle plate 7 is performed easily.

As illustrated in FIG. 1A, the liquid jet head 1 includes the first piezoelectric body substrate 2*a*, the nozzle plate 7 that is an opaque substrate bonded to a side surface SP of the first piezoelectric body substrate 2*a*, and a cover plate 6 bonded to a top surface UP of the first piezoelectric body substrate 2*a*. The first piezoelectric body substrate 2*a* includes n pieces (where n is an integer of 1 or larger; the same is applied hereinafter) of ejection grooves 3 arrayed with an identical pitch P in a reference direction K on the top surface UP, and (n+1) pieces of non-ejection grooves 4 arrayed alternately with the ejection grooves 3 while shifted therefrom by a half pitch (P/2). Accordingly, the non-ejection groove 4 is arranged at both ends of a row of grooves arrayed in the reference direction K.

The nozzle plate 7 is bonded to the side surface SP of the first piezoelectric body substrate 2*a* and has (j+n+k) pieces (where each of j and k is an integer of 1 or larger; the same is applied hereinafter) of through holes 8 passing through the plate in a board thickness direction and arrayed in the reference direction K. Each of n pieces of the through holes 8 communicates with each of the n pieces of the ejection grooves 3, while j pieces of the through holes 8 located at one end side of a row of holes R formed of the n pieces of the through holes 8 communicating with the ejection grooves 3 as well as k pieces of the through holes 8 located at another end side of the row do not communicate with the ejection grooves 3. The cover plate 6 is bonded to the top surface UP of the first piezoelectric body substrate 2*a* to cover a part or all of the ejection grooves 3 and the non-ejection grooves 4. Here, the top surface UP, the side surface SP, and a bottom surface LP opposite to the top surface UP of the first piezoelectric body substrate 2*a* are included as the surface of the first piezoelectric body substrate 2*a*. The n pieces of the ejection grooves 3 and the (n+1) pieces of the non-ejection grooves 4 are opened on the top surface UP and the side surface SP of the first piezoelectric body substrate 2*a*.

The nozzle plate 7 is the opaque substrate made of an opaque material, and the n pieces of the through holes 8 (hereinafter noted as through holes $\mathbf{8}_1$ to $\mathbf{8}_n$) forming the row of holes R function as n pieces of nozzles 11 (hereinafter noted as nozzles $\mathbf{11}_1$ to $\mathbf{11}_n$) that eject a liquid droplet. Note that the n pieces of the nozzles $\mathbf{11}_1$ to $\mathbf{11}_n$, the j pieces of the through holes 8 (hereinafter noted as a through hole 8*a*) located at the one end side of the row of the n pieces of the nozzles $\mathbf{11}_1$ to $\mathbf{11}_n$, namely the row of holes R, and the k pieces of the through holes 8 (hereinafter noted as a through hole 8*b*) located at the other end side of the row are arrayed in a row on the nozzle plate 7 with the pitch P. It is set j=k=1 in FIGS. 1A to 1D representing the present embodiment. Now, the through hole 8*a* located at the one end side of the row of holes R is noted as a through hole $\mathbf{8}a_1$, while the through hole 8*b* located at the other end side is noted as a through hole $\mathbf{8}b_1$. The n pieces of the nozzles $\mathbf{11}_1$ to $\mathbf{11}_n$ are arrayed from the one end side to the other end side in the order of $\mathbf{11}_1, \mathbf{11}_2, \ldots \mathbf{11}_{n-1}$, and $\mathbf{11}_n$.

Therefore, the through hole $\mathbf{8}a_1$ located at the one end side of the row of holes R and the nozzle $\mathbf{11}_1$ (through hole $\mathbf{8}_1$) arranged first in the row of holes R are separated by the pitch P. Likewise, the nozzle $\mathbf{11}_n$ (through hole $\mathbf{8}_n$) arranged in an n-th place of the row of holes R and the through hole $\mathbf{8}b_1$ located at the other end side of the row of holes R are separated by the pitch P. The through hole $\mathbf{8}a_1$ and the through hole $\mathbf{8}b_1$ are placed at a location overlapping with a range L of an opening region in which the non-ejection groove 4 is opened toward the nozzle plate 7, in a direction H orthogonal to the reference direction K and parallel to a substrate surface of the nozzle plate 7. As a result, the non-ejection groove 4 or the ejection groove 3 can be visible through the through hole $\mathbf{8}a_1$ or the through hole $\mathbf{8}b_1$ when the nozzle plate 7 is shifted in the reference direction K by the half pitch (P/2) or more with respect to the first piezoelectric body substrate 2*a*.

The first piezoelectric body substrate 2*a* can be made of PZT ceramics or another piezoelectric material. The nozzle plate 7 is made of a metal plate or an opaque plastic plate, for example. Note that the "opaque" property of the opaque substrate does not allow one to observe the surface of the piezoelectric body substrate when the substrate is bonded to the piezoelectric body substrate. Accordingly, the substrate includes, in addition to the substrate not transmitting light, a substrate which is translucent but exhibits light scattering that is too large to make the surface of the piezoelectric body substrate to which the substrate is bonded observable, and a substrate which is translucent but includes an opaque film formed on the surface of the substrate so that the piezoelectric body substrate to which the substrate is bonded is unobservable. As illustrated in FIGS. 1A to 1D, the ejection groove 3 is formed from the side surface SP to just before an opposing side surface, whereas the non-ejection groove 4 is formed straight to the opposing side surface from the side surface SP. A drive electrode 12 is formed on a side wall of each of the ejection groove 3 and the non-ejection groove 4 and is connected to an electrode terminal 13 formed on the top surface UP. The both side walls of the ejection groove 3 are deformed when a drive signal is applied to the electrode terminal 13, whereby the liquid filling the ejection groove 3 is ejected from the through hole 8, namely, the nozzle 11. Note that the shape of the ejection groove 3 and the non-ejection groove 4 as well as the position and shape of the drive electrode 12 and the electrode terminal 13 are not to be limited to what is illustrated in FIGS. 1A to 1D.

FIG. 1B illustrates a positional relationship between the through holes $\mathbf{8}a_1$, $\mathbf{8}b_1$ and the nozzles $\mathbf{11}_1$ to $\mathbf{11}_n$ and each of the ejection groove 3 and the non-ejection groove 4 when the first piezoelectric body substrate 2*a* and the nozzle plate 7 are aligned correctly. The through holes $\mathbf{8}a_1$ and $\mathbf{8}b_1$ located on both end sides of the row of holes R do not communicate with the ejection groove 3 and the non-ejection groove 4, so that the side surface SP is seen through the through holes $\mathbf{8}a_1$ and $\mathbf{8}b_1$. The n pieces of the nozzles $\mathbf{11}_1$ to $\mathbf{11}_n$ (through holes $\mathbf{8}_1$ to $\mathbf{8}_n$) in the row of holes R communicate with the n pieces of the ejection grooves 3, which are seen through the nozzles $\mathbf{11}_1$ to $\mathbf{11}_n$.

FIG. 1C illustrates the position of each of the through holes $\mathbf{8}a_1$ and $\mathbf{8}b_1$ and the nozzles $\mathbf{11}_1$ to $\mathbf{11}_n$ when the nozzle plate 7 is shifted to the right by the half pitch (P/2) with respect to the first piezoelectric body substrate 2*a*. The non-ejection groove 4 is seen through the through hole $\mathbf{8}a_1$ and the n pieces of the nozzles $\mathbf{11}_1$ to $\mathbf{11}_n$, while the side surface SP of the first piezoelectric body substrate 2*a* is seen through the through hole $\mathbf{8}b_1$. Note that one cannot distinguish whether the groove seen through the through hole 8 is the ejection groove 3 or the non-ejection groove 4. FIG. 1D illustrates the position of each of the through holes $\mathbf{8}a_1$ and $\mathbf{8}b_1$ and the nozzles $\mathbf{11}_1$ to $\mathbf{11}_n$ when the nozzle plate 7 is shifted to the left by the half pitch (P/2) with respect to the first piezoelectric body substrate 2*a*. The non-ejection groove 4 is seen through the through hole $\mathbf{8}b_1$ and the n pieces of the nozzles $\mathbf{11}_1$ to $\mathbf{11}_n$, while the side surface SP of the first piezoelectric body substrate 2*a* is seen through the through hole $\mathbf{8}a_1$.

Accordingly, where the j pieces of the through holes $\mathbf{8}a_1$ to $\mathbf{8}a_j$ are placed at the one end side of the row of holes R and the k pieces of the through holes $8b_1$ to $8b_k$ are placed at the other end side of the row, one can see that the alignment is performed correctly when the side surface SP of the first piezoelectric body substrate 2*a* is seen through the j and k pieces of the through holes 8*a* and 8*b* and when the groove is seen through the n pieces of the nozzles $11_1$ to $11_n$ in the row of holes R, as illustrated in FIG. 1B. The alignment can thus be performed extremely easily with high precision.

Note that the alignment is generally performed on the basis of the way the side surface SP is seen through the j pieces of the through holes $8a_1$ to $8a_j$ located at the one end side of the row of holes R and the k pieces of the through holes $8b_1$ to $8b_k$ located at the other end side of the row. In this case, the through holes $8a_1$ to $8a_j$ and $8b_1$ to $8b_k$ are placed at the location overlapping with the range L of the opening region in which the non-ejection groove 4 is opened toward the nozzle plate 7, in the direction H orthogonal to the reference direction K and parallel to the substrate surface of the opaque substrate (nozzle plate 7). The accurate alignment is performed when the state of the side surface SP seen through the j and k pieces of the through holes $8a_1$ to $8a_j$ and $8b_1$ to $8b_k$ located at both end sides of the row of holes R corresponds with a predetermined pattern while the grooves are visible through all the through holes $8_1$ to $8_n$ forming the row of holes R. In the present embodiment, the alignment is performed correctly when the side surface SP is seen through the two through holes $8a_1$ and $8b_1$ while the ejection grooves 3 are visible through all the through holes $8_1$ to $8_n$ forming the row of holes R.

(Variation)

Figure 2A:
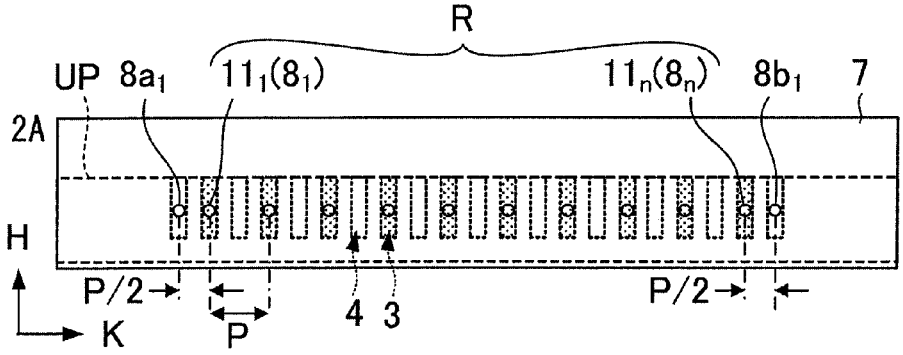
FIGS. 2A to 2C are diagrams illustrating a liquid jet head according to variation of the first embodiment of the present invention.
Figure 2B:
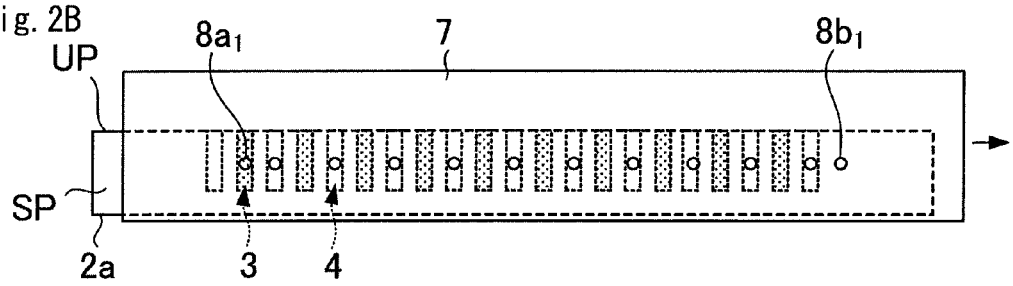
Figure 2C:
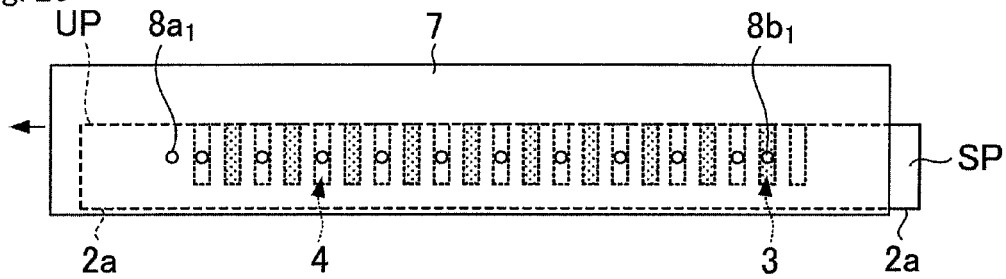

FIGS. 2A to 2C are diagrams illustrating the liquid jet head 1 according to variation of the first embodiment of the present invention. Each of FIGS. 2A to 2C is a schematic front view of the liquid jet head 1 seen from the side of the nozzle plate 7 (opaque substrate). The variation is different from the first embodiment in that each of the nozzles $11_1$ and $11_n$ on both ends of the row of holes R and each of the through holes $8a_1$ and $8b_1$ located at both end sides of the row of holes R are separated by the half pitch (P/2), but the rest of the configuration in the variation is identical to that of the first embodiment.

FIG. 2A illustrates a positional relationship between the nozzles $11_1$ to $11_n$ and the through holes $8a_1$, $8b_1$ and each of the ejection groove 3 and the non-ejection groove 4 when the first piezoelectric body substrate 2*a* and the nozzle plate 7 are aligned correctly. The through holes $8a_1$ and $8b_1$ located on both end sides of the row of holes R do not communicate with the ejection groove 3, so that the non-ejection groove 4 is seen through the through holes $8a_1$ and $8b_1$. However, one cannot distinguish whether the groove seen through the through holes $8a_1$ and $8b_1$ is the ejection groove 3 or the non-ejection groove 4. FIG. 2B illustrates the position of each of the nozzles $11_1$ to $11_n$ and the through holes $8a_1$ and $8b_1$ when the nozzle plate 7 is shifted to the right by the half pitch (P/2) with respect to the first piezoelectric body substrate 2*a*. The ejection groove 3 is seen through the through hole $8a_1$, while the side surface SP is seen through the through hole $8b_1$. The non-ejection groove 4 is seen through each of the n pieces of the nozzles $11_1$ to $11_n$.

FIG. 2C illustrates the positional relationship of the nozzles $11_1$ to $11_n$ and the through holes $8a_1$ and $8b_1$ when the nozzle plate 7 is shifted to the left by the half pitch (P/2) with respect to the first piezoelectric body substrate 2*a*. The side surface SP is seen through the through hole $8a_1$, the ejection groove 3 is seen through the through hole $8b_1$, and the non-ejection groove 4 is seen through each of the n pieces of the nozzles $11_1$ to $11_n$. As a result, the ejection groove 3 and non-ejection groove 4 and the nozzle plate 7 are aligned correctly when in the state illustrated in FIG. 2A where the side surface SP is seen through neither the through hole $8a_1$ nor the through hole $8b_1$.

More generally, the through hole $8a_j$ arranged in a j-th place out of the j pieces of the through holes $8a_1$ to $8a_j$ located at the one end side of the row of holes R and the nozzle $11_1$ (through hole $8_1$) arranged first in the row of holes R may be separated by the pitch P or the half pitch (P/2), while the nozzle $11_n$ (through hole $8_n$) arranged in an n-th place in the row of holes R and the through hole $8b_1$ arranged first in the k pieces of the through holes $8b_1$ to $8b_k$ located at the other end side of the row of holes R may be separated by the pitch P or the half pitch (P/2).

Second Embodiment

Figure 3:
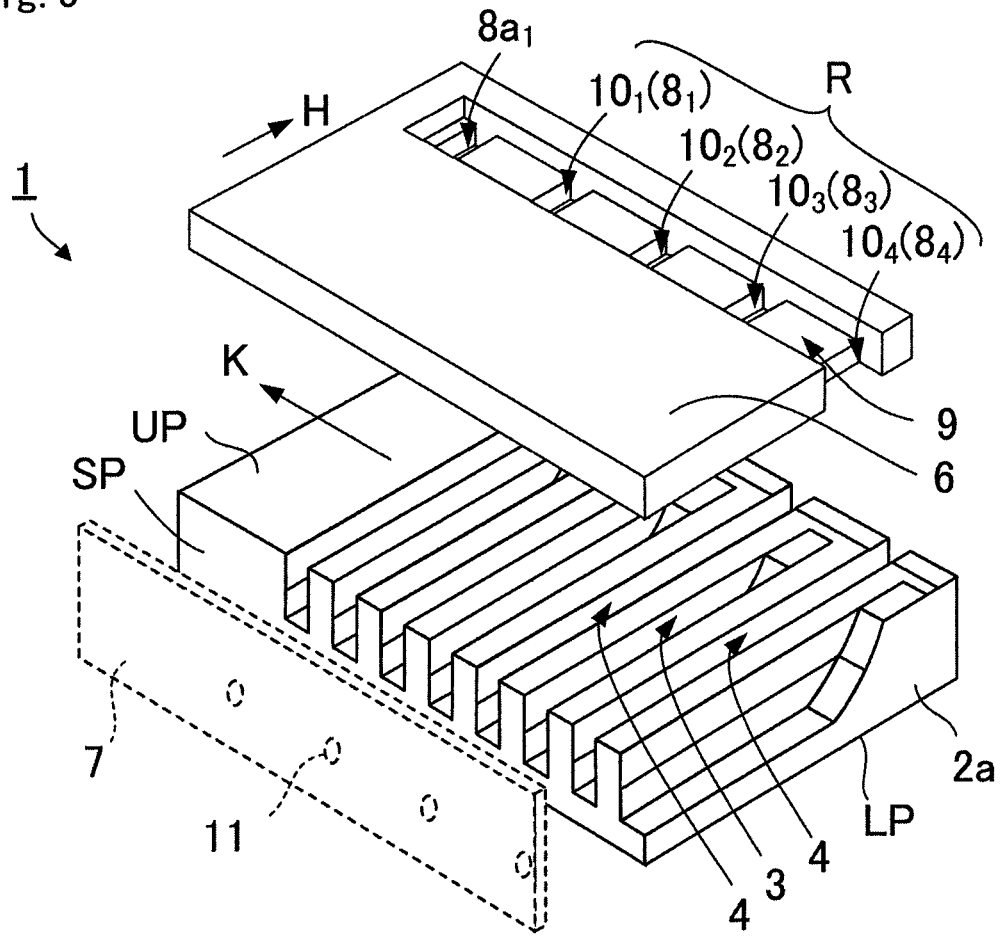
FIG. 3 is a partial exploded perspective view schematically illustrating a liquid jet head according to second embodiment of the present invention.
Figure 4A:
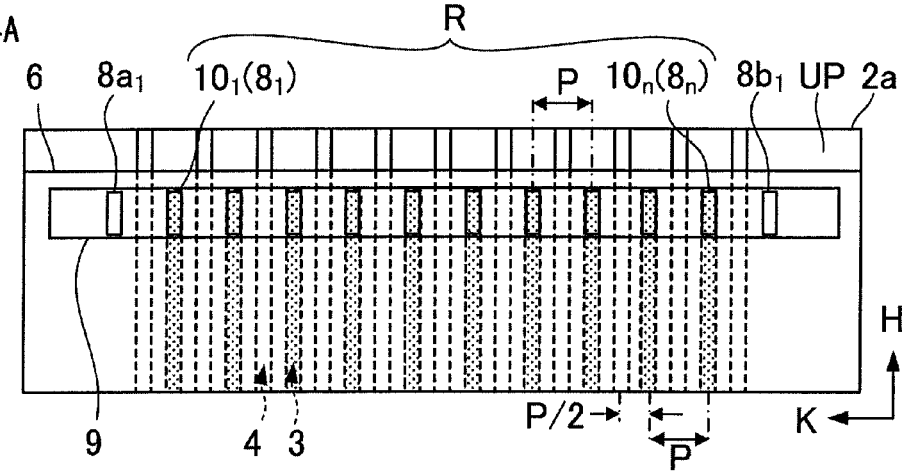
FIGS. 4A to 4C are schematic plan views illustrating the liquid jet head according to the second embodiment of the present invention as seen from a cover plate side.
Figure 4B:
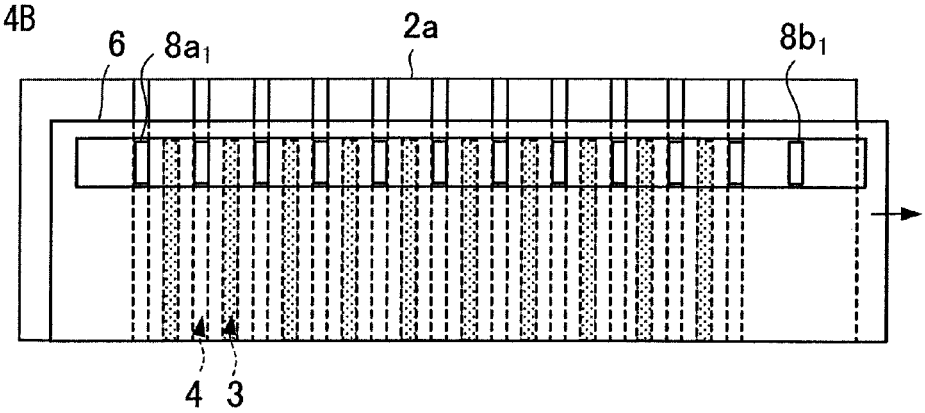
Figure 4C:
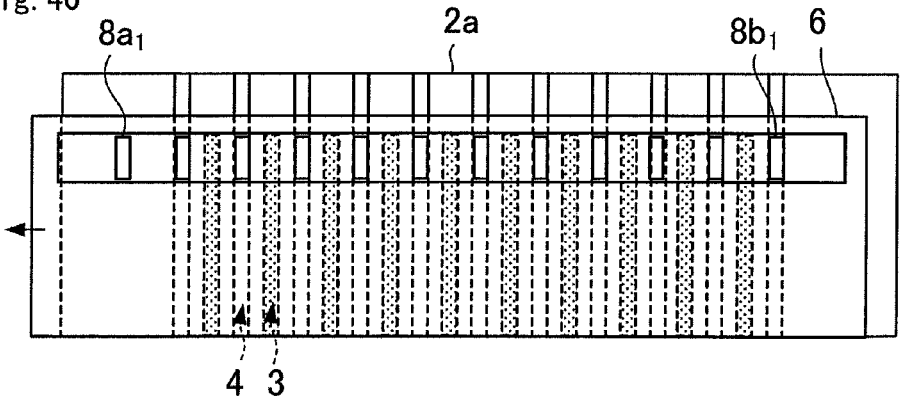

FIG. 3 is a partial exploded perspective view schematically illustrating a liquid jet head 1 according to second embodiment of the present invention. FIGS. 4A to 4C are schematic plan views of the liquid jet head 1 according to the second embodiment of the present invention as seen from the side of a cover plate 6. The present embodiment relates to a structure where alignment between a first piezoelectric body substrate 2*a* and the cover plate 6 is performed easily. A part identical or a part having a function identical to that described in the aforementioned embodiment is assigned the identical reference numeral.

As illustrated in FIG. 3, the liquid jet head 1 includes the first piezoelectric body substrate 2*a*, the cover plate 6 that is an opaque substrate bonded to a top surface UP of the first piezoelectric body substrate 2*a*, and a nozzle plate 7 bonded to a side surface SP of the first piezoelectric body substrate 2*a*. The first piezoelectric body substrate 2*a* includes n pieces of ejection grooves 3 arrayed with an identical pitch P in a reference direction K on the top surface UP, and (n+1) pieces of non-ejection grooves 4 arrayed alternately with the ejection grooves 3 while shifted therefrom by a half pitch (P/2). The cover plate 6 is bonded to the top surface UP of the first piezoelectric body substrate 2*a* and includes (j+n+k) pieces of through holes 8 (slits 10 in the present embodiment) passing through the plate in the board thickness direction and arrayed in the reference direction K. Each of n pieces of slits $10_1$ to $10_n$ (through holes $8_1$ to $8_n$) communicates with each of the n pieces of the ejection grooves 3, and j pieces of the through holes 8 located at one side of a row of holes R formed of the n pieces of the through holes 8 communicating with the ejection grooves 3 as well as k pieces of the through holes 8 located at another end side of the row are blocked by the top surface UP of the first piezoelectric body substrate 2*a*. The nozzle plate 7 includes n pieces of nozzles 11 each communicating with each of the n pieces of the ejection grooves 3, and is bonded to the side surface SP of the first piezoelectric body substrate 2*a*.

Here, the top surface UP of the first piezoelectric body substrate 2*a* is included as the surface that is the outer surface of the first piezoelectric body substrate 2*a*. The cover plate 6 is an opaque substrate formed of an opaque material such as PZT ceramics and opaque plastic. The cover plate 6 includes a liquid chamber 9 which communicates with the n pieces of the slits $10_1$ to ion (through holes $8_1$ to $8_n$). The n pieces of the slits $10_1$ to $10_n$ pass through the plate from a bottom surface of the liquid chamber 9 toward the first piezoelectric body substrate 2*a*. Each of the n pieces of the slits $10_1$ to $10_n$ communicates with each of the n pieces of the ejection grooves 3 but does not communicate with the non-ejection grooves 4. The nozzle plate 7 can be made of a transparent plastic film such as a polyimide film, an opaque metal plate, and the like.

FIG. 4A illustrates a positional relationship between the through holes $\mathbf{8}a_1$ and $\mathbf{8}b_1$ and the slits $\mathbf{10}_1$ to $\mathbf{10}_n$ and each of the ejection groove 3 and the non-ejection groove 4 when the first piezoelectric body substrate 2*a* and the cover plate 6 are aligned correctly. The through holes $\mathbf{8}a_1$ and $\mathbf{8}b_1$ located on both end sides of the row of holes R do not communicate with the ejection groove 3 and the non-ejection groove 4, so that the top surface UP is seen through the through holes $\mathbf{8}a_1$ and $\mathbf{8}b_1$. The n pieces of the slits $\mathbf{10}_1$ to $\mathbf{10}_n$ (n pieces of the through holes $\mathbf{8}_1$ to $\mathbf{8}_n$) form the row of holes R. The n pieces of the slits $\mathbf{10}_1$ to $\mathbf{10}_n$ communicate with the n pieces of the ejection grooves 3, which are seen through each of the slits $\mathbf{10}_1$ to $\mathbf{10}_n$.

FIG. 4B illustrates the position of each of the through holes $\mathbf{8}a_1$ and $\mathbf{8}b_1$ and the slits $\mathbf{10}_1$ to $\mathbf{10}_n$ when the cover plate 6 is shifted to the right by the half pitch (P/2) with respect to the first piezoelectric body substrate 2*a*. The non-ejection groove 4 is seen through the through hole $\mathbf{8}a_1$ and the n pieces of the slits $\mathbf{10}_1$ to $\mathbf{10}_n$, while the top surface UP of the first piezoelectric body substrate 2*a* is seen through the through hole $\mathbf{8}b_1$. Note that one cannot distinguish whether the groove seen through the through hole 8 is the ejection groove 3 or the non-ejection groove 4. FIG. 4C illustrates the position of each of the through holes $\mathbf{8}a_1$ and $\mathbf{8}b_1$ and the slits $\mathbf{10}_1$ to $\mathbf{10}_n$ when the cover plate 6 is shifted to the left by the half pitch (P/2) with respect to the first piezoelectric body substrate 2*a*. The non-ejection groove 4 is seen through the through hole $\mathbf{8}b_1$ and the n pieces of the slits $\mathbf{10}_1$ to $\mathbf{10}_n$, while the top surface UP of the first piezoelectric body substrate 2*a* is seen through the through hole $\mathbf{8}a_1$.

Accordingly, where the j pieces of the through holes $\mathbf{8}a_1$ to $\mathbf{8}a_j$ are placed at the one end side of the row of holes R and the k pieces of the through holes $\mathbf{8}b_1$ to $\mathbf{8}b_k$ are placed at the other end side of the row, the alignment is performed correctly when the top surface UP of the first piezoelectric body substrate 2*a* is seen through the j and k pieces of the through holes 8*a* and 8*b* and when the ejection groove 3 is seen through the n pieces of the slits $\mathbf{10}_1$ to $\mathbf{10}_n$ in the row of holes R, as illustrated in FIG. 4A. The alignment can thus be performed extremely easily with high precision.

Note that the non-ejection groove 4 is formed straight from the side surface SP to an opposing side surface. It is therefore apparent that the through hole $\mathbf{8}a_1$ and the through hole $\mathbf{8}b_1$ are placed at a location overlapping with an opening region in which the non-ejection groove 4 is opened toward the cover plate 6, in a direction H orthogonal to the reference direction K and parallel to a substrate surface of the cover plate 6 (opaque substrate). Moreover, as is the case with the variation of the first embodiment, the through holes $\mathbf{8}a_1$ and $\mathbf{8}b_1$ may be shifted from the slits $\mathbf{10}_1$ and $\mathbf{10}_n$ located on both ends of the row of holes R by the half pitch (P/2).

Third Embodiment

Figure 5A:
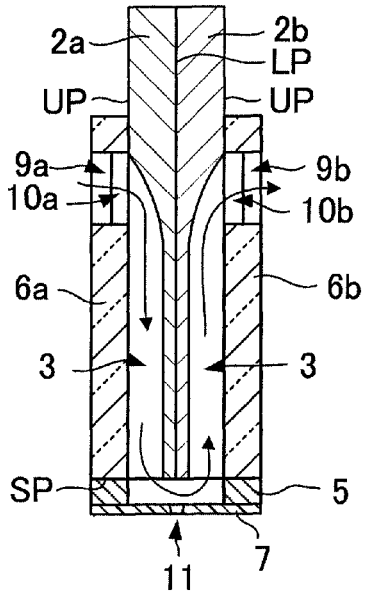
FIGS. 5A to 5C are diagrams illustrating a liquid jet head according to third embodiment of the present invention.
Figure 5B:
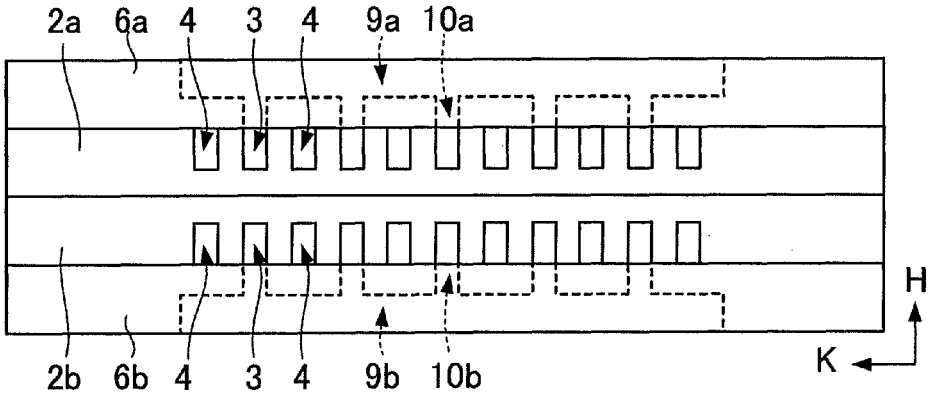
Figure 5C:
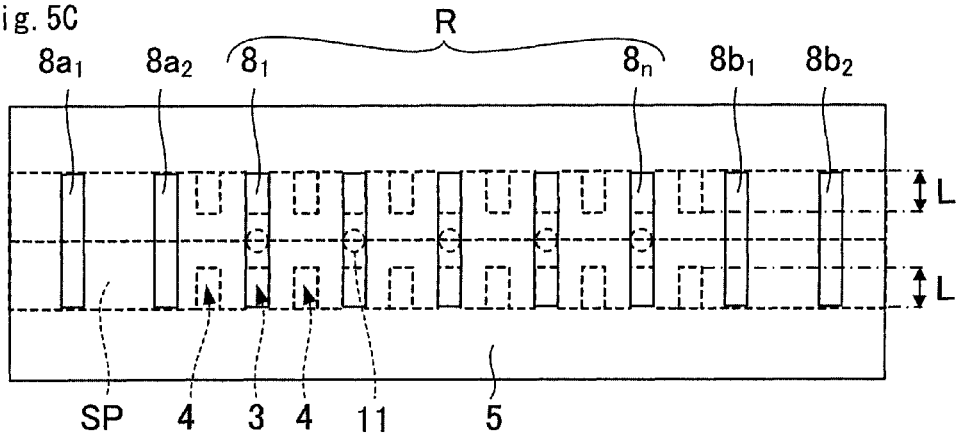

FIGS. 5A to 5C are diagrams illustrating a liquid jet head 1 according to third embodiment of the present invention. FIG. 5A is a schematic cross sectional view along a groove direction of an ejection groove 3 of the liquid jet head 1, FIG. 5B is a schematic front view seen from the side of a nozzle plate 7 which is removed from the diagram, and FIG. 5C is a schematic plan view of a communication board 5. The present embodiment provides the liquid jet head 1 of a through-flow type where bottom surfaces of two piezoelectric body substrates are bonded to each other so that the ejection groove on one piezoelectric body substrate communicates with the ejection groove on another piezoelectric body substrate in the vicinity of the nozzle plate, thereby causing liquid to circulate through the ejection groove. A part identical or a part having a function identical to that described in the aforementioned embodiments is assigned the identical reference numeral.

As illustrated in FIG. 5A, the jet head 1 includes: first and second piezoelectric body substrates 2*a* and 2*b*, bottom surfaces LP of which are bonded to each other; first and second cover plates 6*a* and 6*b* which are bonded to each top surface UP of the first and second piezoelectric body substrates 2*a* and 2*b*, respectively; the communication board 5 which is an opaque substrate bonded to a side surface SP of each of the first and second piezoelectric body substrates 2*a* and 2*b*; and the nozzle plate 7 which is bonded to a side of the communication board 5 opposite to the side bonded to the piezoelectric body substrate. Specific description will be provided as follows.

Each of the first and second piezoelectric body substrates 2*a* and 2*b* includes n pieces of ejection grooves 3 arrayed with an identical pitch P in a reference direction K on the top surface UP, and (n+1) pieces of non-ejection grooves 4 arrayed alternately with the ejection grooves 3 while shifted therefrom by a half pitch (P/2). The first piezoelectric body substrate 2*a* and the second piezoelectric body substrate 2*b* are formed into a 1 piece while arranging the side surfaces SP of each of the piezoelectric body substrates flush with each other and arranging the bottom surfaces LP opposite to the top surface UP of the substrates to face each other. Note that the first and second piezoelectric body substrates 2*a* and 2*b* are identical to the first piezoelectric body substrate 2*a* described in the first or second embodiment.

As illustrated in FIGS. 5A to 5C, the communication board 5 is bonded to the side surface SP of the first and second piezoelectric body substrates 2*a* and 2*b*, and includes (j+n+k) pieces of through holes 8 passing through the board in the board thickness direction and arrayed in the reference direction K. Each of n pieces of through holes $\mathbf{8}_1$ to $\mathbf{8}_n$ forming a row of holes R communicates with each of the n pieces of the ejection grooves 3 of the first piezoelectric body substrate 2*a* as well as each of the n pieces of the ejection grooves 3 of the second piezoelectric body substrate 2*b*. That is, the through hole $\mathbf{8}_1$ arranged first among the n pieces of the through holes $\mathbf{8}_1$ to $\mathbf{8}_n$ in the reference direction K brings the ejection groove 3 arranged first in the reference direction K on the first piezoelectric body substrate 2*a* in communication with the ejection groove 3 arranged first in the reference direction K on the second piezoelectric body substrate 2*b*. Likewise, the through hole $\mathbf{8}_n$ arranged in an n-th place brings the n-th ejection groove 3 on the first piezoelectric body substrate 2*a* in communication with the n-th ejection groove 3 on the second piezoelectric body substrate 2*b*. As a result, the ejection groove 3 of the first and second piezoelectric body substrates 2*a* and 2*b* can be seen through the through hole 8. Moreover, j pieces of through holes $\mathbf{8}a_1$ to $\mathbf{8}a_j$ located at one end side of the row of holes R and k pieces of through holes $\mathbf{8}b_1$ to $\mathbf{8}b_k$ located at another end side of the row are blocked by the side surface SP of the first and second piezoelectric body substrates 2*a* and 2*b*, and thus do not communicate with the ejection groove 3. In other words, the side surface SP is seen through the through holes $\mathbf{8}a_1$ to $\mathbf{8}a_j$ and $\mathbf{8}b_1$ to $\mathbf{8}b_k$. Note that, in the present embodiment, the (j+n+k) pieces of the through holes 8 on the communication board 5 are arranged with a pitch P which is identical to the pitch P of the ejection groove 3, where it is set j=k=2.

The first cover plate 6*a* includes a first liquid chamber 9*a* and n pieces of slits 10*a* communicating with the first liquid chamber 9*a*. The second cover plate 6*b* includes a second liquid chamber 9*b* and *n* pieces of slits 10*b* communicating with the second liquid chamber 9*b*. The first cover plate 6*a* is bonded to the top surface UP of the first piezoelectric body substrate 2*a* while each of the n pieces of the slits 10*a* communicates with each of the n pieces of the ejection grooves 3. The second cover plate 6*b* is bonded to the top surface UP of the second piezoelectric body substrate 2*b* while each of the n pieces of the slits 10*b* communicates with each of the n pieces of the ejection grooves 3. The nozzle plate 7 includes n pieces of nozzles 11, each of which communicates with each of the n pieces of the through holes $\mathbf{8}_1$ to $\mathbf{8}_n$, and is bonded to the side of the communication board 5 opposite to the side bonded to the first and second piezoelectric body substrates 2*a* and 2*b*.

As has already been described, the first and second piezoelectric body substrates 2*a* and 2*b* can be made of PZT ceramics or another piezoelectric body substrate. The first and second cover plates 6*a* and 6*b* can be made of PZT ceramics, another ceramics, a metal plate, a plastic plate, or the like. The communication board 5 can be made of a metal plate, opaque ceramics, an opaque plastic plate, or another opaque plate. The nozzle plate 7 can be made of a polyimide film, another plastic film, a metal plate, or the like.

FIG. 5C illustrates a positional relationship between the through holes 8*a* and 8*b* and the row of holes R formed of the through holes $\mathbf{8}_1$ to $\mathbf{8}_n$ and each of the ejection groove 3 and the non-ejection groove 4 when the first and second piezoelectric body substrates 2*a* and 2*b* and the communication board 5 are aligned correctly. The side surface SP is seen through the two through holes $\mathbf{8}a_1$ and $\mathbf{8}a_2$ located at the one end side of the row of holes R, and the side surface SP is also seen through the two through holes $\mathbf{8}b_1$ and $\mathbf{8}b_2$ located at the other end side of the row. That is, the four through holes $\mathbf{8}a_1$, $\mathbf{8}a_2$, $\mathbf{8}b_1$, and $\mathbf{8}b_2$ located at both end sides of the row of holes R do not communicate with any of the ejection grooves 3. When the communication board 5 is shifted to the right by the half pitch (P/2), on the other hand, the side surface SP is seen through the through hole $\mathbf{8}a_1$ at the one end side, the side surface SP is also seen through the two through holes $\mathbf{8}b_1$ and $\mathbf{8}b_2$ at the other end side, and an opening of the non-ejection groove 4 is seen through the rest of the through holes $\mathbf{8}a_2$ and $\mathbf{8}_1$ to $\mathbf{8}_n$. Likewise, when the communication board 5 is shifted to the left by the half pitch (P/2), the side surface SP is seen through the through hole $\mathbf{8}b_2$ at the other end side, the side surface SP is also seen through the two through holes $\mathbf{8}a_1$ and $\mathbf{8}a_2$ at the one end side, and the opening of the non-ejection groove 4 is seen through the rest of the through holes $\mathbf{8}b_1$ and $\mathbf{8}_1$ to $\mathbf{8}_n$. The side surface SP seen through the through holes $\mathbf{8}a_1$ and $\mathbf{8}a_2$ located at the one end side is different from the side surface SP seen through the through holes $\mathbf{8}b_1$ and $\mathbf{8}b_2$ located at the other end side when the communication board 5 is shifted to the right or left by the half pitch (P/2) or more with respect to the first piezoelectric body substrate 2*a*, in which case it is apparent that the alignment is not performed correctly. Accordingly, the first and second piezoelectric body substrates 2*a* and 2*b* and the communication board 5 can be aligned extremely easily with high precision on the basis of the way the side surface is seen through the through hole 8 located at both end sides.

The liquid jet head 1 is operated as follows. First, liquid is supplied to the first liquid chamber 9*a*. The liquid flows into the n pieces of the ejection grooves 3 on the first piezoelectric body substrate 2*a* through each of the n pieces of the slits 10*a* as indicated by an arrow. The liquid in each ejection groove 3 then flows into the n pieces of the ejection grooves 3 on the second piezoelectric body substrate 2*b* through each of the through holes $\mathbf{8}_1$ to $\mathbf{8}_n$ of the communication board 5. The liquid further flows out to the second liquid chamber 9*b* through the n pieces of the slits 10*b* on the second cover plate 6*b* and is discharged to the outside. Next, a drive signal is applied to two side walls between the ejection groove 3 on the first piezoelectric body substrate 2*a* and each of two non-ejection grooves 4 sandwiching the ejection groove 3, as well as to two side walls between the ejection groove 3 on the second piezoelectric body substrate 2*b* communicating with the ejection groove 3 on the first piezoelectric body substrate 2*a* and each of two non-ejection grooves 4 sandwiching the ejection groove 3 on the second piezoelectric body substrate 2*b*, thereby driving the side walls. In other words, the four side walls are driven simultaneously to generate a pressure wave in the ejection groove 3 on the first piezoelectric body substrate 2*a* and the ejection groove 3 on the second piezoelectric body substrate 2*b* simultaneously so that a liquid droplet is ejected from the nozzle 11.

Note that in general, the through hole $\mathbf{8}a_j$ arranged in a j-th place out of the j pieces of the through holes 8*a* located at the one end side of the row of holes R formed of the n pieces of the through holes 8 and the through hole $\mathbf{8}_1$ arranged first in the row of holes R are separated by the pitch P or the half pitch (P/2), while the through hole $\mathbf{8}_n$ arranged in an n-th place and the through hole $\mathbf{8}b_1$ arranged first in the k pieces of the through holes 8*b* located at the other end side of the row of holes R are separated by the pitch P or the half pitch (P/2). Moreover, the j pieces of the through holes 8 located at the one end side of the row of holes R and the k pieces of the through holes 8 located at the other end side of the row are placed at a location overlapping with a range L of an opening region in which the non-ejection groove 4 on the first and second piezoelectric body substrates 2*a* and 2*b* is opened toward the communication board 5, in a direction H orthogonal to the reference direction K and parallel to a substrate surface of the communication board 5. As a result, the alignment between the first and second piezoelectric body substrates 2*a* and 2*b* and the communication board 5 can be performed extremely easily with high precision.

Fourth Embodiment

Figure 6A:
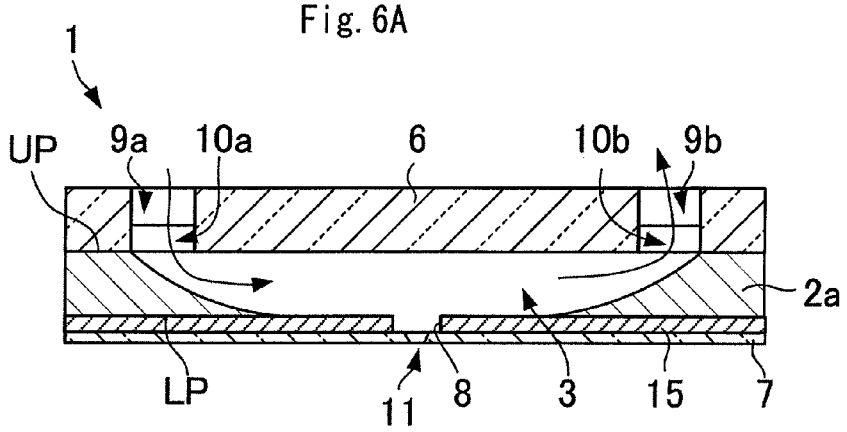
FIGS. 6A and 6B are diagrams illustrating a liquid jet head according to fourth embodiment of the present invention.
Figure 6B:
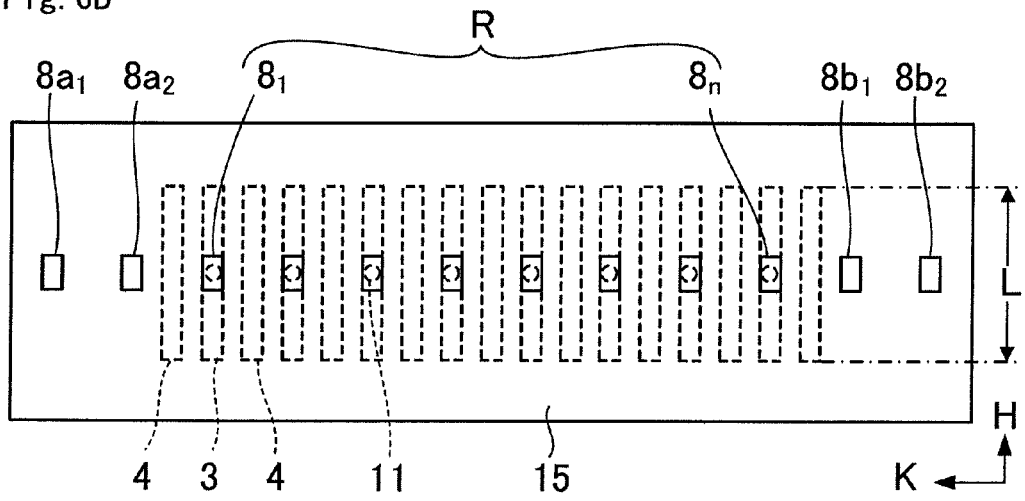

FIGS. 6A and 6B are diagrams illustrating a liquid jet head 1 according to fourth embodiment of the present invention. FIG. 6A is a schematic cross sectional view of the liquid jet head 1 along a groove direction of an ejection groove 3, and FIG. 6B is a schematic plan view from which a nozzle plate 7 is removed to look at a side of a reinforcing plate 15 bonded to a bottom surface LP of a first piezoelectric body substrate 2*a* opposite to a top surface UP thereof. In the present embodiment, the ejection groove 3 and a non-ejection groove 4 pass through the first piezoelectric body substrate 2*a* from the top surface UP to the bottom surface LP thereof, and the nozzle plate 7 is installed on the side of the bottom surface LP. A part identical or a part having a function identical to that described in the aforementioned embodiments is assigned the identical reference numeral.

The liquid jet head 1 includes the first piezoelectric body substrate 2*a*, a cover plate 6 bonded to the top surface UP of the first piezoelectric body substrate 2*a*, the reinforcing plate 15 that is an opaque substrate bonded to the bottom surface LP of the first piezoelectric body substrate 2*a* opposite to the top surface UP thereof, and the nozzle plate 7 installed to a side of the reinforcing plate 15 opposite to the side bonded to the first piezoelectric body substrate 2*a*. The first piezoelectric body substrate 2*a* includes n pieces of the ejection grooves 3 arrayed with an identical pitch P in a reference direction K on the top surface UP, and (n+1) pieces of non-ejection grooves 4 arrayed alternately with the ejection grooves 3 while shifted therefrom by a half pitch (P/2). The ejection groove 3 and the non-ejection groove 4 pass through the first piezoelectric body substrate 2*a* in the board thickness direction thereof and are opened on the bottom surface LP opposite to the top surface UP. The reinforcing plate 15 is bonded to the bottom surface LP of the first piezoelectric body substrate 2*a* and has (j+n+k) pieces of through holes 8 passing through the plate in the board thickness direction thereof and arrayed in the reference direction K. Each of n pieces of the through holes $\mathbf{8}_1$ to $\mathbf{8}_n$ communicates with each of the n pieces of the ejection grooves 3, while j pieces of through holes 8*a* located at one end side of a row of holes R formed of the n pieces of the through holes $\mathbf{8}_1$ to $\mathbf{8}_n$ as well as k pieces of through holes 8*b* located at another end side of the row do not communicate with any of the ejection grooves 3. Note that, in the present embodiment, the (j+n+k) pieces of the through holes 8 on the reinforcing plate 15 are arranged with a pitch P which is identical to the pitch P of the ejection groove 3, where it is set j=k=2.

The cover plate 6 includes a first liquid chamber 9*a*, a second liquid chamber 9*b* separated from the first liquid chamber 9*a*, n pieces of slits 10*a* which bring the first liquid chamber 9*a* in communication with each of the n pieces of the ejection grooves 3, and n pieces of slits 10*b* which bring the second liquid chamber 9*b* in communication with each of the n pieces of the ejection grooves 3. The slit 10*a* communicates at one side of the ejection groove 3, and the slit 10*b* communicates at another side of the ejection groove 3. The nozzle plate 7 includes n pieces of nozzles 11, each of which communicates with each of then pieces of the through holes $\mathbf{8}_1$ to $\mathbf{8}_n$.

Here, the bottom surface LP of the first piezoelectric body substrate 2*a* is included as the surface of the first piezoelectric body substrate 2*a*. The first piezoelectric body substrate 2*a*, the reinforcing plate 15, the cover plate 6, and the nozzle plate 7 are made of the same material as that described in the other embodiments. The reinforcing plate 15 in the present embodiment has a function of reinforcing the nozzle plate 7. The pressure wave induced on liquid filling the ejection groove 3 is attenuated by the nozzle plate 7 when the diameter of the ejection groove 3 opened on the bottom surface LP is large and the thin nozzle plate 7 is directly adhered to the bottom surface LP. Therefore, the reinforcing plate 15 having the higher hardness than the nozzle plate 7 is adhered to the bottom surface LP to restrain the attenuation of the pressure wave.

FIG. 6B illustrates a positional relationship between the through holes 8 and each of the ejection groove 3 and the non-ejection groove 4 when the first piezoelectric body substrate 2*a* and the reinforcing plate 15 are aligned correctly. The bottom surface LP is seen through two through holes $\mathbf{8}a_1$ and $\mathbf{8}a_2$ located at the one end side of the row of holes R, and the bottom surface LP is also seen through two through holes $\mathbf{8}b_1$ and $\mathbf{8}b_2$ located at the other end side of the row. That is, the four through holes $\mathbf{8}a_1$, $\mathbf{8}a_2$, $\mathbf{8}b_1$, and $\mathbf{8}b_2$ located at both end sides of the row of holes R do not communicate with any of the ejection grooves 3. Similar to the case in the third embodiment, the bottom surface LP seen through the through holes $\mathbf{8}a_1$ and $\mathbf{8}a_2$ located at the one end side is different from the bottom surface LP seen through the through holes $\mathbf{8}b_1$ and $\mathbf{8}b_2$ located at the other end side when the reinforcing plate 15 is shifted by the half pitch (P/2) or more with respect to the first piezoelectric body substrate 2*a*, in which case it is apparent that the alignment is not performed correctly. Accordingly, the first piezoelectric body substrate 2*a* and the reinforcing plate 15 can be aligned extremely easily with high precision on the basis of the way the bottom surface is seen through the through holes 8*a* and 8*b* located at both end sides.

The liquid jet head 1 is operated as follows. Liquid supplied to the first liquid chamber 9*a* flows into the ejection groove 3 from one end thereof through the slit 10*a* and flows out to the second liquid chamber 9*b* from another end of the ejection groove 3 through the slit 10*b*, as indicated by an arrow. Then, a drive signal is applied to two side walls between the ejection groove 3 and each of two non-ejection grooves 4 sandwiching the ejection groove 3 to simultaneously drive the two side walls, so that a liquid droplet is ejected from the nozzle 11 communicating with the through hole 8 by generating the pressure wave on the liquid filling the ejection groove 3.

Note that in the present embodiment as well, it is generally the case that the through hole $\mathbf{8}a_j$ arranged in a j-th place out of the j pieces of the through holes 8*a* located at the one end side of the row of holes R formed of the n pieces of the through holes 8 and the through hole $\mathbf{8}_1$ arranged first in the row of holes R are separated by the pitch P or the half pitch (P/2), while the through hole $\mathbf{8}_n$ arranged in an n-th place and the through hole $\mathbf{8}b_1$ arranged first in the k pieces of the through holes 8*b* located at the other end side of the row of holes R are separated by the pitch P or the half pitch (P/2). Moreover, the j pieces of the through holes 8 located at the one end side of the row of holes R and the k pieces of the through holes 8 located at the other end side of the row are placed at a location overlapping with a range L of an opening region in which the non-ejection groove 4 on the first piezoelectric body substrates 2*a* is opened toward the reinforcing plate 15, in a direction H orthogonal to the reference direction K and parallel to a substrate surface of the reinforcing plate 15. As a result, the alignment between the first piezoelectric body substrates 2*a* and the reinforcing plate 15 can be performed extremely easily with high precision.

Fifth Embodiment

Figure 7:
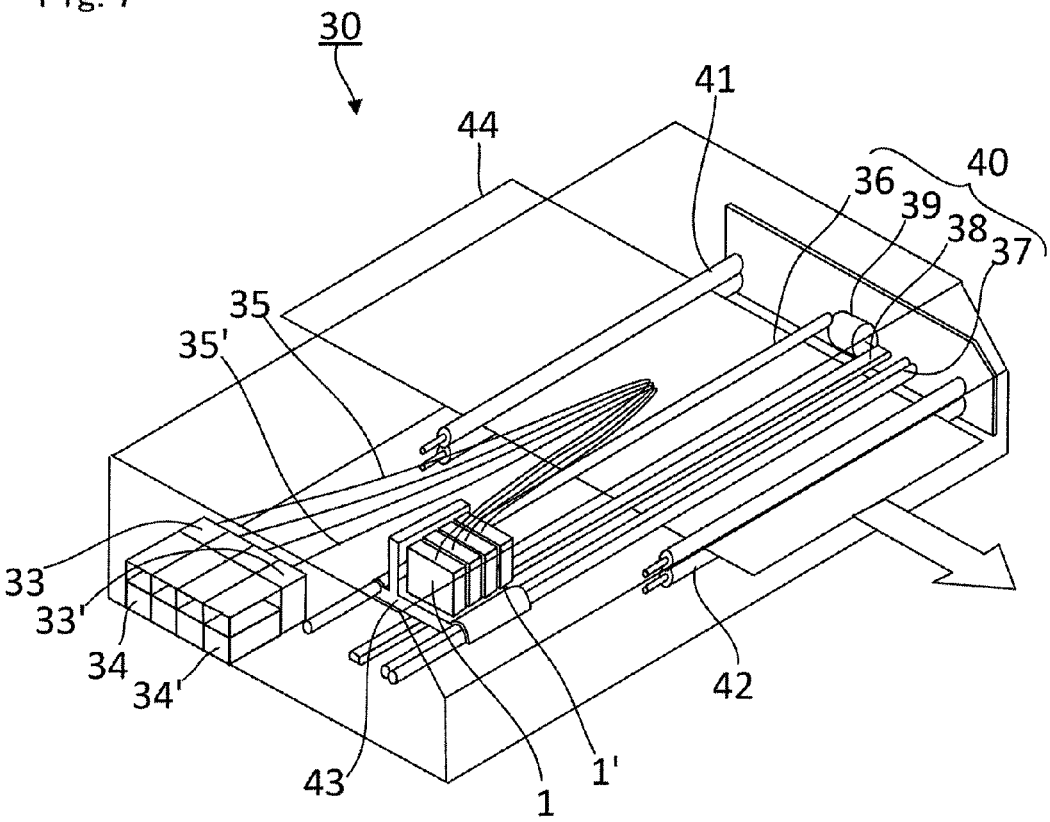
FIG. 7 is a schematic perspective view illustrating a liquid jet apparatus according to fifth embodiment of the present invention.
Figure 8:
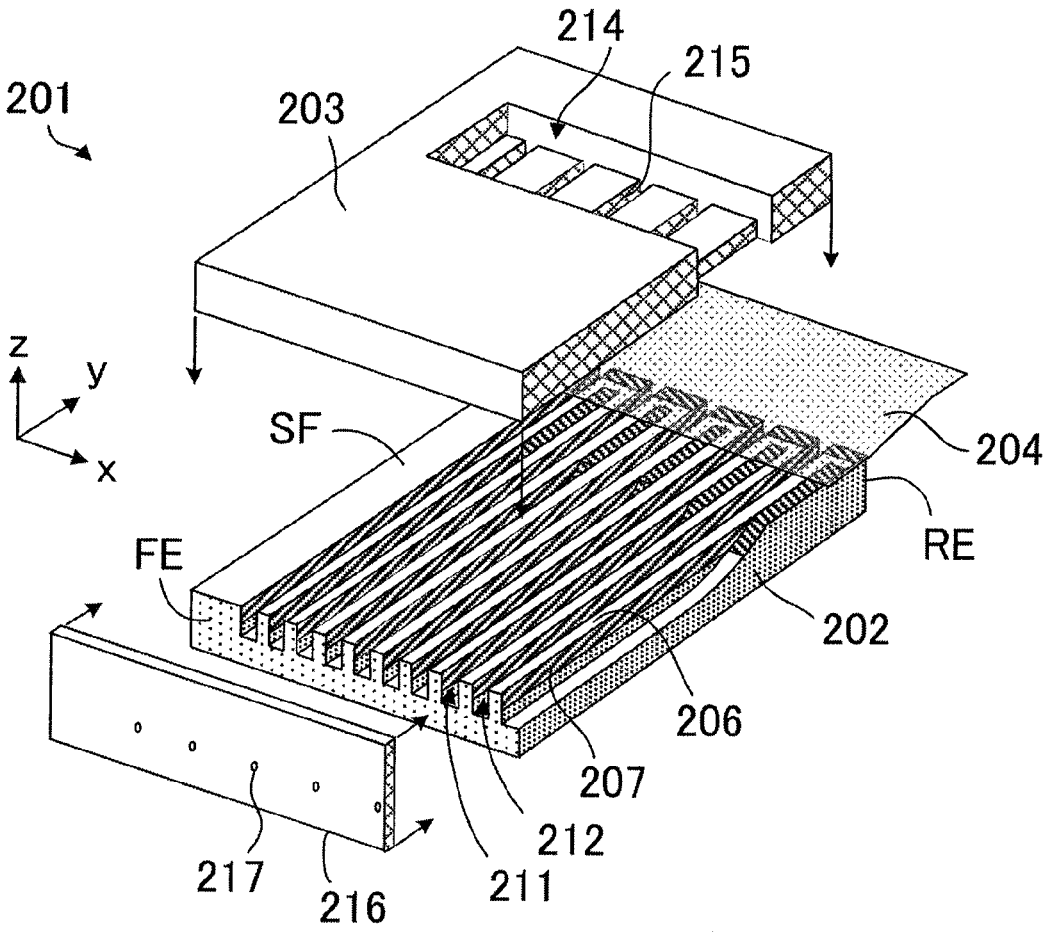
FIG. 8 is an exploded perspective view of a liquid jet head that is known in the related art.
Figure 9:
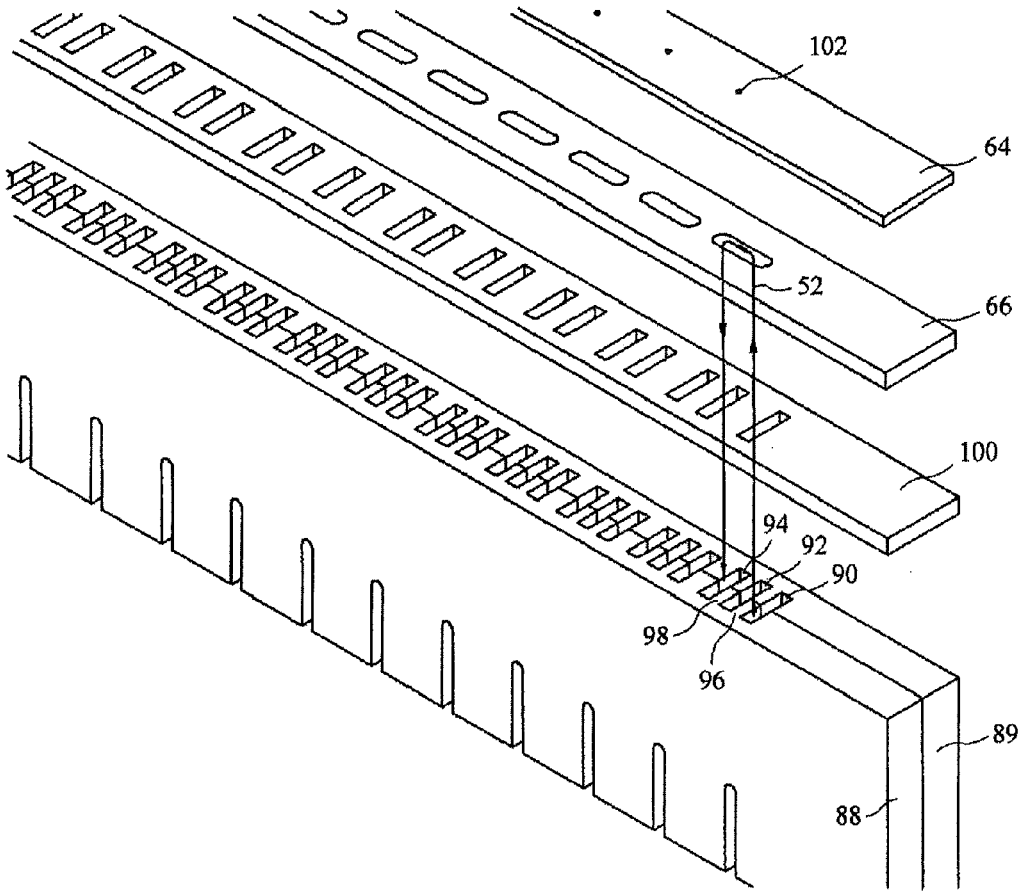
FIG. 9 is an exploded perspective view of another liquid jet head that is known in the related art.

FIG. 7 is a schematic perspective view illustrating a liquid jet apparatus 30 according to fifth embodiment of the present invention. The liquid jet apparatus 30 includes: a move mechanism 40 which moves liquid jet heads 1 and 1' back and forth; flow path parts 35 and 35' which supply liquid to the liquid jet heads 1 and 1' and discharge the liquid from the liquid jet heads 1 and 1'; and liquid pumps 33 and 33' as well as liquid tanks 34 and 34' that communicate with the flow path parts 35 and 35'. Each of the liquid jet heads 1 and 1' includes a piezoelectric body substrate 2, a cover plate 6, and a nozzle plate 7. The liquid is circulated by installing, as the liquid pumps 33 and 33', one or both of a supply pump supplying the liquid to the flow path parts 35 and 35' and a discharge pump discharging the liquid to somewhere other than the flow path parts. Moreover, the flow rate of the liquid may be controlled by installing a pressure sensor or a flow rate sensor that is not shown. The liquid jet heads 1 and 1' include an ejection groove 3 and a non-ejection groove 4 that are arrayed alternately on a top surface UP of a first or second piezoelectric body substrate 2*a* or 2*b*, and an opaque substrate is bonded to a surface of the first or second piezoelectric body substrate 2*a* or 2*b*. The liquid jet head described in any one of the aforementioned first to fourth embodiments is used as the liquid jet heads 1 and 1'.

The liquid jet apparatus 30 includes: a pair of conveyance means 41 and 42 which convey a recording medium 44 such as paper in a main scanning direction; the liquid jet heads 1 and 1' which eject the liquid, to the recording medium 44; a carriage unit 43 on which the liquid jet heads 1 and 1' are mounted; the liquid pumps 33 and 33' which supply the liquid stored in the liquid tanks 34 and 34' while pressing the liquid against the flow path parts 35 and 35'; and the move mechanism 40 which scans the liquid jet heads 1 and 1' in a sub-scanning direction orthogonal to the main scanning direction. A control unit that is not shown controls and drives the liquid jet heads 1 and 1', the move mechanism 40, and the conveyance means 41 and 42.

The pair of conveyance means 41 and 42 extend in the sub-scanning direction and include a grid roller and a pinch roller that rotate while bringing a roller surface into contact with each other. The grid roller and the pinch roller are rotated around the shaft thereof by a motor not shown to convey the recording medium 44 pinched between the rollers in the main scanning direction. The move mechanism 40 includes: a pair of guide rails 36 and 37 which extend in the sub-scanning direction; the carriage unit 43 which can slide along the pair of guide rails 36 and 37; an endless belt 38 which moves the carriage unit 43 in the sub-scanning direction by being connected thereto; and a motor 39 which rotates the endless belt 38 through a pulley that is not shown.

The plurality of liquid jet heads 1 and 1' is mounted on the carriage unit 43, which ejects four kinds of liquid droplets including yellow, magenta, cyan, and black, for example. The liquid tanks 34 and 34' store liquid of the corresponding color and supply the liquid to the liquid jet heads 1 and 1' through the liquid pumps 33 and 33' and the flow path parts 35 and 35'. Each of the liquid jet heads 1 and 1' ejects the liquid droplet of each color according to a drive signal. An arbitrary pattern can be recorded onto the recording medium 44 by controlling a timing at which the liquid is ejected from the liquid jet heads 1 and 1', rotation of the motor 39 driving the carriage unit 43, and a speed of conveying the recording medium 44.

Note that while the present embodiment provides the liquid jet apparatus 30 in which the carriage unit 43 and the recording medium 44 are moved by the move mechanism 40 to perform recording, there may be provided instead a liquid jet apparatus in which the carriage unit is fixed and the recording medium is moved two-dimensionally by the move mechanism to perform recording. That is, the move mechanism may be adapted to move the liquid jet head and the recording medium relatively to each other.

What is claimed is:

1. A liquid jet head comprising:

a first piezoelectric body substrate having n pieces (where n is an integer of 1 or larger) of ejection grooves arrayed with an identical pitch P in a reference direction on a surface of the first piezoelectric body substrate and (n+1) pieces of non-ejection grooves arrayed alternately with the ejection grooves while shifted from the ejection grooves by a half pitch (P/2); and an opaque substrate bonded to the surface of the first piezoelectric body substrate and having a plurality of pieces of through holes passing through the opaque substrate in a thickness direction thereof and arrayed in the reference direction;

wherein the plurality of pieces of through holes comprises n pieces of through holes communicating with the respective n pieces of the ejection grooves, a first through hole which is not in communication with any of the ejection grooves and is located outside of one end side of a row of holes formed of the n pieces of through holes communicating with the ejection grooves, and a second through hole which is not in communication with any of the ejection grooves and is located outside of another end side of the row of holes.

2. The liquid jet head according to claim 1, wherein the first through hole and one of the through holes from the row of through holes located at one end of the n pieces of through holes are separated by the pitch P or the half pitch (P/2), and the second through hole and another of the through holes located at another end of the n pieces of through holes are separated by the pitch P or the half pitch (P/2).

3. The liquid jet head according to claim 1, wherein the first through hole and the second through hole are formed in the opaque substrate at a location between opposite ends of the non-ejection grooves in a direction orthogonal to the reference direction and parallel to a surface of the opaque substrate.

4. The liquid jet head according to claim 1, wherein the opaque substrate is a nozzle plate having n pieces of nozzles formed of the n pieces of through holes.

5. The liquid jet head according to claim 1, further comprising a nozzle plate having n pieces of nozzles, wherein the n pieces of nozzles communicate with the respective n pieces of through holes, and the nozzle plate is bonded to a side of the opaque substrate opposite to a side thereof bonded to the first piezoelectric body substrate.

6. The liquid jet head according to claim 1, wherein the ejection grooves and the non-ejection grooves are arrayed on a top surface of the first piezoelectric body substrate, the opaque substrate is a cover plate having a liquid chamber communicating with the n pieces of through holes, and the cover plate is bonded to the top surface of the first piezoelectric body substrate.

7. The liquid jet head according to claim 4, wherein the n pieces of ejection grooves and the (n+1) pieces of non-ejection grooves are opened on a side surface of the first piezoelectric body substrate.

8. The liquid jet head according to claim 5, further comprising:

a second piezoelectric body substrate having n pieces of second ejection grooves arrayed with the identical pitch P in the reference direction on a surface of the second piezoelectric body substrate and having (n+1) pieces of second non-ejection grooves arrayed alternately with the second ejection grooves while shifted from the second ejection grooves by the half pitch (P/2), wherein the first piezoelectric body substrate and the second piezoelectric body substrate are formed in one piece with side surfaces of the first and second piezoelectric body substrates being arranged flush with each other and bottom surfaces of the first and second piezoelectric body substrates being arranged in opposite and confronting relation to each other, and wherein each of the through holes brings one of the ejection grooves opened on the side surface of the first piezoelectric body substrate in communication with one of the ejection grooves opened on the side surface of the second piezoelectric body substrate.

9. The liquid jet head according to claim 8, further comprising:

a first cover plate having a first liquid chamber and n pieces of slits communicating with the first liquid chamber; and a second cover plate having a second liquid chamber and n pieces of slits communicating with the second liquid chamber, wherein the first cover plate is bonded to a top surface of the first piezoelectric body substrate while each of the n pieces of slits of the first cover plate communicates with each of the n pieces of ejection grooves, and wherein the second cover plate is bonded to a top surface of the second piezoelectric body substrate while each of the n pieces of slits of the second cover plate communicates with each of the n pieces of ejection grooves.

10. The liquid jet head according to claim 4, wherein the n pieces of ejection grooves and the (n+1) pieces of non-ejection grooves are opened on a top surface of the first piezoelectric body substrate and a bottom surface of the first piezoelectric body substrate opposite to the top surface.

11. A liquid jet apparatus comprising:

the liquid jet head according to claim 1;

a movement mechanism for moving the liquid jet head and a recording medium relatively to each other;

a liquid supply tube for supplying liquid to the liquid jet head; and a liquid tank for supplying the liquid to the liquid supply tube.

12. A liquid jet head comprising:

a piezoelectric body substrate having a plurality of ejection grooves arrayed with an identical pitch P in a reference direction and a plurality of non-ejection grooves arrayed alternately with the ejection grooves while shifted from the ejection grooves by a half pitch (P/2); and an opaque substrate bonded to the piezoelectric body substrate and having a plurality of through holes arrayed in the reference direction, the plurality of through holes comprising a row of through holes corresponding in number to and communicating with the respective plurality of ejection grooves, a first through hole arranged outside of one end side of the row of through holes so that it does not communicate with any of the plurality of ejection grooves, and a second through hole arranged outside of another end side of the row of through holes so that it does not communicate with any of the plurality of ejection grooves.

13. The liquid jet head according to claim 12, wherein the first through hole and one of the through holes from the row of through holes at one end thereof are separated from one another by the pitch P or the half pitch (P/2); and wherein the second through hole and another of the through holes from the row of through holes at another end thereof are separated from one another by the pitch P or the half pitch (P/2).

14. The liquid jet head according to claim 12, wherein the first through hole and the second through hole are formed in the opaque substrate at a location between opposite ends of the plurality of non-ejection grooves in a direction orthogonal to the reference direction.

15. The liquid jet head according to claim 12, wherein the plurality of ejection grooves and the plurality of non-ejection grooves are arrayed on a top surface of the piezoelectric body substrate; and wherein the opaque substrate comprises a cover plate bonded to the top surface of the piezoelectric body substrate and having a liquid chamber communicating with the row of through holes.

16. The liquid jet head according to claim 12, wherein the opaque substrate comprises a nozzle plate; and wherein the plurality of ejection grooves and the plurality of non-ejection grooves are opened on a side surface of the piezoelectric body substrate.

17. The liquid jet head according to claim 12, wherein the opaque substrate comprises a nozzle plate; and wherein the plurality of ejection grooves and the plurality of non-ejection grooves are opened on opposite surfaces of the piezoelectric body substrate.

18. The liquid jet head according to claim 12, wherein the piezoelectric body substrate comprises a first piezoelectric body substrate, the plurality of ejection grooves comprises a plurality of first ejection grooves, and the plurality of non-ejection grooves comprises a plurality of second non-ejection grooves; and further comprising a second piezoelectric body substrate formed in one piece with the first piezoelectric body substrate with side surfaces of the first and second piezoelectric body substrates being arranged flush with each other and bottom surfaces of the first and second piezoelectric body substrates being arranged in opposite and confronting relation to each other, the second piezoelectric body substrate having a plurality of second ejection grooves arrayed with an identical pitch P in the reference direction and a plurality of second non-ejection grooves arrayed alternately with the plurality of second ejection grooves while shifted from the plurality of second ejection grooves by a half pitch (P/2), the plurality of second ejection grooves and the plurality of second non-ejection grooves corresponding in number with the plurality of first ejection grooves and the plurality of first non-ejection grooves, respectively.

19. The liquid jet head according to claim 18, further comprising:

a first cover plate having a first liquid chamber and a plurality of first slits corresponding in number to the plurality of first ejection grooves and communicating with the first liquid chamber; and a second cover plate having a second liquid chamber and a plurality of second slits corresponding in number to the plurality of second ejection grooves and communicating with the second liquid chamber, wherein the first cover plate is bonded to a top surface of the first piezoelectric body substrate while the plurality of first slits communicates with the respective plurality of first ejection grooves, and wherein the second cover plate is bonded to a top surface of the second piezoelectric body substrate while the plurality of second slits communicates with the respective plurality of second ejection grooves.

20. A liquid jet apparatus comprising:

the liquid jet head according to claim 12;

a movement mechanism for moving the liquid jet head and a recording medium relatively to each other;

a liquid supply tube for supplying liquid to the liquid jet head; and a liquid tank for supplying the liquid to the liquid supply tube.

* * * * *